US005342173A

United States Patent [19]

Vera

[11] Patent Number: 5,342,173

[45] Date of Patent: Aug. 30, 1994

[54] COWL FOR FAN AND ITS APPLICATION TO A VEHICLE MOTORIZED FAN UNIT

[75] Inventor: Jean-Claude Vera, Valentigney, France

[73] Assignee: ECIA-Equipements et Composants Pour l'Industrie Automobile, Audincourt, France

[21] Appl. No.: 972,536

[22] Filed: Nov. 6, 1992

[30] Foreign Application Priority Data

Nov. 7, 1991 [FR] France ..... 91 13755

[51] Int. Cl.[5] ..... F04D 29/68

[52] U.S. Cl. ..... 416/169 A; 415/914; 416/192

[58] Field of Search ..... 416/169 A, 192; 415/914; 165/51, 122, 41; 123/198 RE, 195 C

[56] References Cited

U.S. PATENT DOCUMENTS

| | | | |
|---|---|---|---|
| 2,030,993 | 2/1936 | Langenkamp et al. | 416/169 A |
| 3,903,960 | 9/1975 | Beck et al. | 415/914 |
| 3,995,603 | 12/1976 | Thien et al. | 416/169 A |
| 4,061,188 | 12/1977 | Beck | 415/914 |
| 4,730,664 | 3/1988 | Forsthuber et al. | 165/51 |

FOREIGN PATENT DOCUMENTS

| | | | |
|---|---|---|---|
| 26997 | 4/1981 | European Pat. Off. . | |
| 183581 | 6/1986 | European Pat. Off. . | |
| 445804 | 9/1991 | European Pat. Off. . | |
| 2256051 | 7/1975 | France . | |
| 2497883 | 7/1982 | France | 416/169 A |
| 2603953 | 3/1988 | France . | |
| 176499 | 10/1984 | Japan | 416/169 A |
| WO8505408 | 12/1985 | PCT Int'l Appl. . | |

*Primary Examiner*—John T. Kwon

*Attorney, Agent, or Firm*—Sughrue, Mion, Zinn, Macpeak & Seas

[57] ABSTRACT

A cowl comprising, inter alia, a stationary part formed by a diffuser (10) which exhibits a fastening base (11), a nozzle-funnel (12), a connection zone (13), a cylindrical skirt (14), and a moving part (20) able to rotate about an axis (200), which moving part (21) exhibits a peripheral profiled annular hoop (20) which is intended to be rigidly connected to the blade (22) tips (221) of a helix and which is mounted coaxially in this skirt (14) so as to be able to rotate therein, is characterised in that, taking as references the direction of flow and the axis (200), this hoop (21) is delimited by an inner wall (2101), an outer wall (2102) and a rear section (2103), this connection zone (13) is delimited in particular by an inner surface (131) with an upstream limit (1310), and in that this rear section (2103) of the hoop (21) is situated in a plane (P) which is perpendicular to the axis (200) and which passes practically through the upstream limit (1310) of the inner surface (131) of the connection zone (13).

8 Claims, 2 Drawing Sheets

COWL FOR FAN AND ITS APPLICATION TO A VEHICLE MOTORIZED FAN UNIT

BACKGROUND OF THE INVENTION

The present invention relates to fans and, more particularly, to an improved cowl for the latter and its application to motorised fan units for example for vehicles.

In numerous industrial fields, it is necessary to combine a fan with a radiator or other type of heat exchanger. This is, for example, the case in the motor industry where motorised fan units are fitted to the radiators used for cooling the heat engine for driving vehicles or heat exchangers used for example for air conditioning of the passenger compartment of vehicles.

As is known, it is not easy to control the flow streams of the air agitated by a fan helix so as to improve its efficiency, at constant air flow rate, without thereby increasing the energy necessary for driving the helix of the fan and also without noticeably increasing the sound level during operation.

Various attempts have been made. Some relate to the profile of the blades of the helix, others relate to the cowl of the helix made, therefore, from a stationary part connected to the radiator or to the exchanger and a moving part connected to the blade tips of the fan.

One solution of the first type is, for example, illustrated by the document FR 2,603,953 corresponding to U.S. Pat. No. 4,739,077 . This document proposes giving the blades of the helix a profile such that the thin streams of air close to the hub which carries the roots of the blades describe centripetal trajectories, whereas the thin streams of air closest to the tips of the blades follow centrifugal trajectories. One solution of the other type is, for example, illustrated by the document EP 0,026,997 corresponding to U.S. Pat. No. 4,329,946 . This document proposes using a cowl for a suction fan, placed downstream of the radiator in the direction of flow of the air. This cowl comprises a stationary part or diffuser with a cylindrical skirt and a moving part with a peripheral profiled annular hoop which is rigidly connected to the tips of the blades of the helix and which is mounted coaxially with this skirt so as to be able to rotate therein. In order to attempt to prevent disturbing countercurrents which circulate between skirt and hoop from downstream to upstream, it is arranged that the air streams closest to the blade tips are ejected so as to make a fluid barrier which prevents the circulation of such disturbing countercurrents. It will nevertheless be observed that this solution which, in principle, prevents undesirable back flow of agitated fluid, necessitates a relatively significant clearance between the skirt and the hoop.

SUMMARY OF THE INVENTION

The object of the invention is to overcome this type of difficulty, most especially in the case where a fan is placed upstream, in the direction of flow of the fluid, from a radiator or from an exchanger.

The subject of the invention is an improved cowl for a fan comprising, inter alia, a stationary part formed by a diffuser which exhibits a fastening base, a nozzle-funnel, a connection zone, a cylindrical skirt, and a moving part able to rotate about an axis, which moving part exhibits a peripheral profiled annular hoop which is intended to be rigidly connected to the blade tips of a helix and which is mounted coaxially in this skirt so as to be able to rotate therein. This cowl is characterised in that, taking as references the direction of flow and the axis, this hoop is delimited by an inner wall, an outer wall and a rear section, this connection zone is delimited in particular by an inner surface with an upstream limit, and in that this rear section of the hoop is situated in a plane which is perpendicular to the axis and which passes practically through the upstream limit of the inner surface of the connection zone.

The subject of the invention is also the application of such a cowl to motorised fan units, for example, for vehicles.

Other characteristics and advantages of the invention will emerge upon reading the description and the claims which follow, as well as from examining the appended drawing, given solely by way of example, in which:

DESCRIPTION OF PREFERRED EMBODIMENTS

Figure 1:
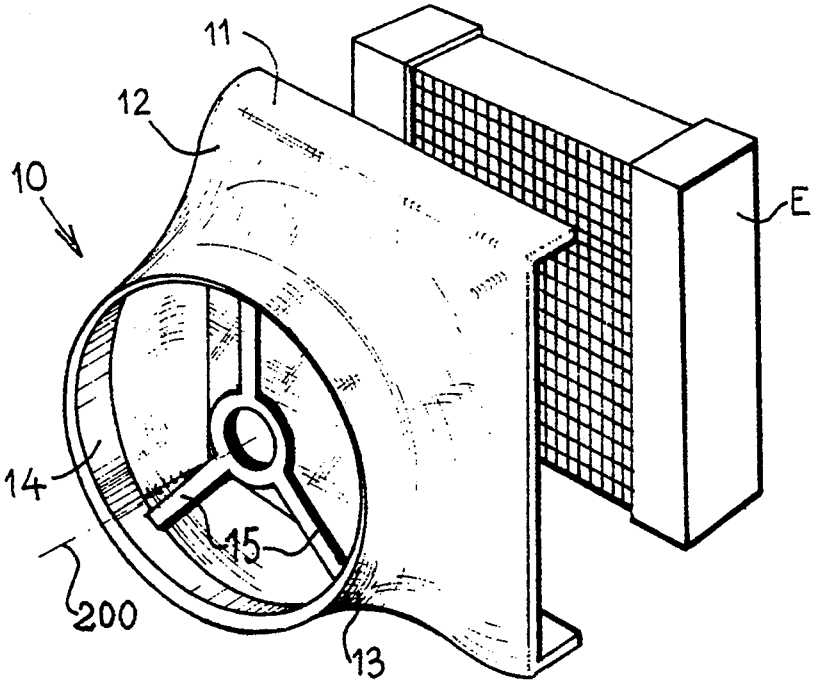
FIG. 1 is a partially expanded perspective view of an embodiment of a cowl according to the invention in its application to a motorised fan unit for a vehicle radiator.
Figure 2:
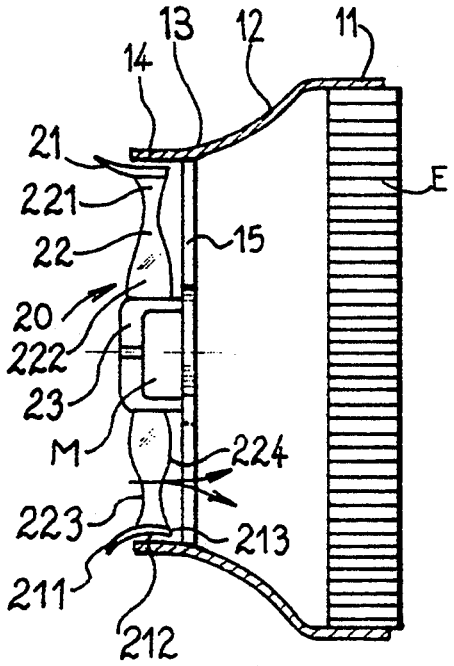
FIG. 2 is a diagrammatic meridian section of a cowl according to the invention.
Figure 3:
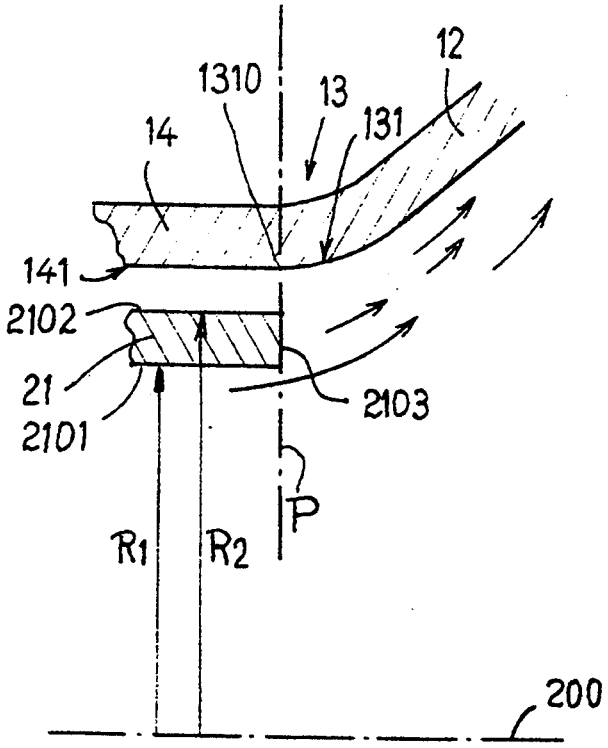
FIG. 3 is a detailed local meridian section of FIG. 2, not to scale, so as to facilitate the illustration.
Figure 4:
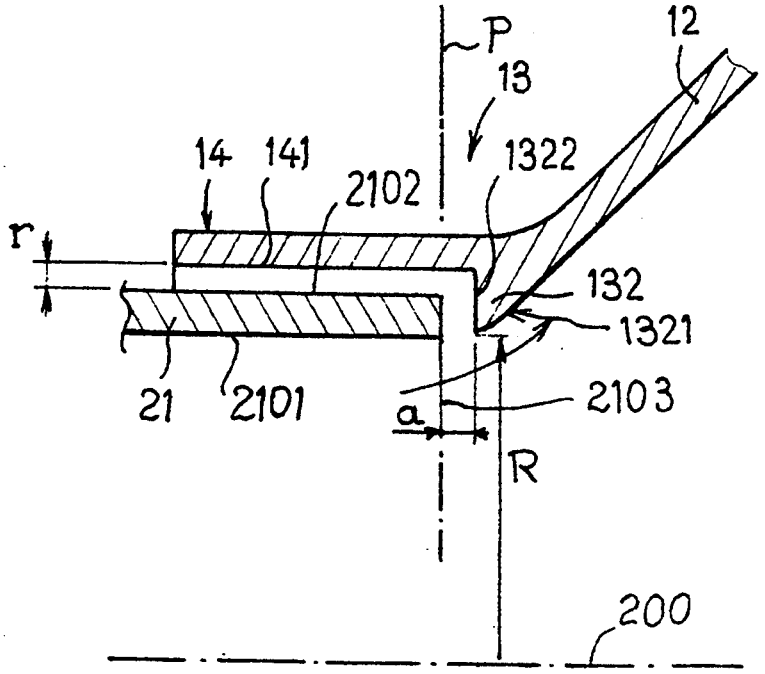
FIG. 4 is a view similar to that of FIG. 3 of a variant embodiment of the invention.

Since fans and in particular their cowls, especially those used in the motor industry, are well known in the technology, the description which follows will describe only that which directly or indirectly relates to the invention. For the remainder, the specialist in the technology in question will draw upon the current conventional solutions at his disposal in order to deal with the particular problems with which he is confronted.

In the description which follows, the same reference numeral always identifies a similar element regardless of the embodiment or variant.

For convenience of the account, each of the constituent parts of an improved cowl for a fan according to the invention will be described successively before describing the operation and construction thereof.

As can be seen, a cowl for a fan comprises a stationary part 10, commonly called a diffuser or shroud, and a moving part 20 commonly called a hooped helix, capable of rotating about an axis 200. The air flows are shown diagrammatically by an arrow.

The stationary part 10 or diffuser, comprises a base 11 intended for fastening to an exchanger E, a radiator or the like as illustrated. This diffuser also comprises a nozzle-funnel 12 and a connection zone 13 for joining this nozzle-funnel to a skirt 14. The skirt 14 is, preferably, cylindrical and coaxial with the axis 200 whereas the base 11 is generally designed so as to be fixed to a rectangular exchanger E or radiator so that the nozzle-funnel 12 has an approximately cylindro-pyramidal configuration, the cylindrical part being situated upstream and the pyramidal part downstream relative to the direction of flow. This diffuser also comprises radial arms 15, for example three, intended to support an electric motor M for driving a shaft on which the hub of the helix or moving part 20 is mounted.

The moving part or helix 20 comprises a profiled annular hoop 21, blades 22 and a hub 23. As can be seen, this hoop is delimited by an inner wall 2101, an outer wall 2102 and a rear section 2103. This hoop 21 comprises a rim 211, a collar 212 and an extension 213. Each blade 22 comprises a tip 221 towards the outside and a root 222 towards the axis, a leading edge 223 and a trailing edge 224. The tips 221 of the blades are intended to be rigidly connected to the hoop 21 whereas their roots 222 are intended to be rigidly connected to the hub 23.

As can be seen, the connection zone 13 of the diffuser 10 is delimited in particular by an inner surface 131 having an upstream limit 1310.

The distances which separate the axis 200 from the inner wall 2101 and from the outer wall 2102 of the hoop 21, measured at the rear section 2103, are respectively designated by $R_1$ and $R_2$.

As can be seen in the Figures of the drawing, according to the invention the hoop 21 is mounted in the skirt 14 so that its rear section 2103 is situated practically in a plane P (or in the immediately vicinity), which is perpendicular to the axis 200 and which passes through the upstream limit 1310 of the inner surface 131 of the connection zone 13.

By virtue of the judicious positioning which has just been indicated, the air flow which leaves the helix flares out as soon as it enters the diffuser, "adhering" to the inner wall of the latter. This has the effect of minimising, or even eliminating, the creation of a turbulent zone which is manifested in the state of a toric vortex which would contribute to the formation of a backflow current between skirt and hoop which would circulate in a countercurrent manner.

In order to improve this effect, according to a variant embodiment of the invention, there is arranged on the inner surface 131 of the connection zone 13 of the diffuser 10, a bead or step 132 which projects internally and which is placed in the vicinity of the upstream limit 1310 of this connection zone. This bead 132 is designed to exhibit a profiled face 1321 for joining preferably with a plane face 1322 configured as a radial ring. This face 1321 is such that it is situated, in its zone which is closest to it, at a distance R from the axis 200, which is practically equal to or only slightly different from the distance $R_1$ separating this axis from the inner wall 2101 of the hoop 21, measured at the rear section 2103 of the hoop. According to the invention, this plane radial ring-shaped face 1322 is situated in the plane P or in the immediate vicinity, which is perpendicular to the axis 200 and which passes through the upstream limit 1310 of the inner surface 131 of the connection zone 13.

Preferably, the distance R satisfies the relationship $R=\frac{1}{3}(2R_1+R_2)$ where $R_2$ is the distance between the axis 200 and the outer wall 2102 of the hoop 21.

The measurements adopted for the bead or step 132 ensure physical or aerodynamic continuity of the inner wall 2101 of the hoop 21 with the inner surface 131 of the connection zone 13, practically without a break.

So that the transition region is as small as possible, it is arranged that the axial spacing a between the plane radial ring-shaped face 1322 of the bead 132 and the rear section 2103 of the hoop 21 is practically equal to the radial spacing r which separates the inner surface 141 of the skirt 14, from the outer surface 2102 of the hoop 21 which faces it.

In this way, the centrifugal turbulent flow in the region of the blade tips can flare out into the diffuser, "adhering" to its walls, for example by the Coanda effect.

The existence of this bead or step creates a type of mechanical "baffle" or the like which makes it possible to minimise, or even reduce to its most simple expression, the circulation backflow between the downstream outflow part of the helix and the upstream suction part.

The stationary part is for example made, partly or entirely, from sheet metal or synthetic resin(s). The same applies for the moving part.

By virtue of the invention, the cooling performance is increased and the fan efficiency enhanced.

The invention will find a particular application for the radiators of vehicle heat engines, whether they be single or double motorised fan units and most especially when such motorised fan units are placed upstream of the radiator or exchanger.

All the advantages provided by the cowl according to the invention will be understood.

What is claimed is:

1. An improved cowl for a fan, comprising a stationary part formed by a diffuser (10) which has an entrance section followed by an exit section disposed in a downstream direction relative to air flow from said entrance section to said exit section, and which also has in the following order in an upstream direction; a fastening base (11), a nozzle-funnel (12) located in said exit section, a connection zone (13), a cylindrical skirt (14) located in said entrance section and joined to said nozzle-funnel (12) by said connection zone (13), and a moving part (20) rotatable about an axis (200), which moving part (20) has a peripheral profiled annular hoop (21) which is intended to be rigidly connected to the blade (22) tips (221) of a helix which is mounted coaxially in said skirt (14) so as to be able to rotate therein, wherein, taking as references the direction of flow and the axis (200), said hoop (21) is delimited by an inner wall (2101), an outer wall (2102) and a rear section (2103), wherein said connection zone (13) is delimited by an inner surface (131) with an upstream limit (1310), and wherein said rear section (2103) of the hoop (21) is situated in a plane (P) which is perpendicular to said axis (200) and which passes practically through said upstream limit (1310) of said internal surface (131) of the connection zone (13).

2. The cowl according to claim 1, wherein said inner surface (131) of the connection zone (13) carries a bead (132) which projects internally and which is placed in the vicinity of said upstream limit (1310), and wherein a face (1321) of said bead (132) in a zone closest to said axis (200) is separated from said axis (200) by a first distance R which is practically equal to a second distance $(R_1)$ separating said axis (200) from said inner wall (2101) of the hoop (21), said first distance (R) being measured at said rear section (2103).

3. The cowl according to claim 2, wherein said bead (132) is delimited upstream by a plane radial ring-shaped face (1322) situated practically in said plane (P) which passes through said upstream limit (1310) of the inner surface (131) of the connection zone (13).

4. The cowl according to claim 2 or 3, wherein said first distance (R) practically satisfies the relationship $R=\frac{1}{3}(2R_1+R_2)$, where $R_1$ and $R_2$ are respectively the distances separating said axis (200) from said inner wall (2101) and said outer wall (2102) of the hoop (21) respectively, measured at said rear section (2103).

5. The cowl according to claim 3, wherein a radial spacing (r), between an inner surface (141) of the skirt (14) and said outer hoop wall (2102) which faces it, is practically equal to the axial spacing (a) between said plane radial ring-shaped face (1322) of the bead (132) and said rear section (2103) of the hoop.

6. The cowl according to claim 1, wherein said moving part (20) is a motorized fan unit for a vehicle.

7. The cowl according to claim 1 or 2, wherein said nozzle-funnel (12) has an approximately cylindro-pyramidal configuration having a cylindrical part located upstream of a pyramidal part.

8. The cowl according to claim 1, wherein said diffuser (10) comprises three radial arms (15) for supporting an electric motor which drives a shaft on which said moving part (20) is mounted.

* * * * *